US010533333B2

(12) United States Patent
Shin

(10) Patent No.: US 10,533,333 B2
(45) Date of Patent: Jan. 14, 2020

(54) FITNESS MODULE BOX

(71) Applicants: Dong Geon Shin, Seoul (KR); Hangil Yu, Goyang-si (KR)

(72) Inventor: Dong Geon Shin, Seoul (KR)

(73) Assignees: Dong Geon Shin, Seoul (KR); Hangil Yu, Goyang-si (KR)

( * ) Notice: Subject to any disclaimer, the term of this patent is extended or adjusted under 35 U.S.C. 154(b) by 0 days.

(21) Appl. No.: 16/205,222

(22) Filed: Nov. 30, 2018

(65) Prior Publication Data

US 2019/0301183 A1 Oct. 3, 2019

(30) Foreign Application Priority Data

Mar. 28, 2018 (KR) ..... 10-2018-0035562

(51) Int. Cl.

| | |
|---|---|
| ***E04B 1/34*** | (2006.01) |
| ***E04H 1/00*** | (2006.01) |
| ***E04H 1/12*** | (2006.01) |
| ***E04H 3/14*** | (2006.01) |
| ***E04B 1/343*** | (2006.01) |
| ***E04B 1/348*** | (2006.01) |
| *A63B 1/00* | (2006.01) |
| *A63B 22/02* | (2006.01) |

(Continued)

(52) U.S. Cl.

CPC ..... *E04H 3/14* (2013.01); *E04B 1/34315* (2013.01); *E04B 1/34384* (2013.01); *E04B 1/34861* (2013.01); *E04H 1/005* (2013.01); *E04H 1/125* (2013.01); *E04H 1/1205* (2013.01); *A63B 1/00* (2013.01); *A63B 21/0628* (2015.10); *A63B 21/4037* (2015.10); *A63B 22/02* (2013.01); *A63B 2220/806* (2013.01)

(58) Field of Classification Search

CPC ..... E04B 1/34331; E04B 1/34315; E04B 1/34384; E04B 1/34861; E04H 1/00; E04H 1/005; E04H 1/02; E04H 1/12; E04H 1/1205; E04H 1/1211; E04H 1/1244; E04H 1/125; E04H 2001/1283; E04H 3/10; E04H 3/14

USPC ..... 52/79.1, 79.7, 79.9, 79.12

See application file for complete search history.

(56) References Cited

U.S. PATENT DOCUMENTS 9,750,999 B2 * 9/2017 Monaco ..... E04H 3/14
2006/0242924 A1 * 11/2006 Kwon ..... E04B 1/4142 52/704

(Continued)

FOREIGN PATENT DOCUMENTS

DE 3718877 A1 * 12/1988 ..... E04H 3/14

*Primary Examiner* — Ryan D Kwiecinski

(57) ABSTRACT

A fitness module box including a box body having an entrance in a side. The box body includes a framework having a structure and a finishing plate structure finishing outer surfaces of the framework. In the framework top frames spaced apart from bottom frames are connected to the bottom frames using side frames. The fitness module box is provided as a modular structure, such that two or more such fitness module boxes can be connected together, allowing the scale of a fitness facility to be adjusted in consideration of the number of users. An operator may have a significant advantage in terms of the operation of the fitness facility. A user may make a reservation for one of a variety of fitness module boxes at a desirable place and time, and may pay a fee based on the time of use.

5 Claims, 12 Drawing Sheets

(51) Int. Cl.
*A63B 21/062* (2006.01)
*A63B 21/00* (2006.01)

(56) References Cited

U.S. PATENT DOCUMENTS

2012/0255253 A1* 10/2012 DeZaio ..... E04C 2/384
52/475.1
2015/0255002 A1* 9/2015 Harris ..... G09B 19/003
434/247
2016/0059105 A1* 3/2016 Scade Garcia ..... E04H 1/12
52/69
2017/0197109 A1* 7/2017 Cole ..... A63B 22/0089

* cited by examiner

FITNESS MODULE BOX

CROSS REFERENCE TO RELATED APPLICATION

The present application claims priority under 35 U.S.C. 119(a) to Korean Patent Application No. 10-2018-0035562, filed on Mar. 28, 2018, which is herein incorporated by reference in its entirety.

BACKGROUND

Technical Field

The present disclosure relates generally to a fitness module box and, more particularly, to a fitness module box provided in the shape of a module in a variety of places, such as an outdoor place and an indoor place, the fitness module being configured to accommodate various sets of exercise equipment, such that users who have no or little time to meet an expert can simply use such exercise equipment.

Description of the Related Art

Since obese or overweight people are gradually increasing due to overeating and lack of exercise, the necessity of healthcare of modern people is gradually increasing. In addition, interest in health is highly increasing among people.

Accordingly, a lot of people use fitness centers to improve physical fitness. People generally register for annual memberships, monthly memberships, or the like to pay for use of fitness centers, and during contracted periods, visit fitness centers to exercise by using exercise equipment provided in fitness centers.

However, people may be able to exercise at fitness centers only a small number of times, due to a variety of reasons, such as overtime work and company dinners during weekdays, as well as rest at home, a variety of other schedules, and hobbies on weekends. Thus, in many cases, people waste money without exercising at fitness centers a sufficient number of times during contracted periods of use.

Accordingly, there is demand for a solution allowing users to exercise at a fitness center provided with desirable exercise equipment at a desirable time, as well as a payment system allowing users to pay a fee at each time or based on an amount of time in which exercise equipment is used, instead of paying on annually or monthly basis, which is burdensome.

The information disclosed in the Background section is only for the enhancement of understanding of the background of the invention, and should not be taken as an acknowledgment or as any form of suggestion that this information forms a prior art that would already be known to a person skilled in the art.

SUMMARY

Accordingly, the present disclosure has been made keeping in mind the above problems occurring in the related art, and the present disclosure proposes a fitness module box provided as a modular structure, such that two or more such fitness module boxes can be connected together, allowing the scale of the fitness facility to be adjusted in consideration of the number of users. Thus, an operator may have a significant advantage in terms of the operation of the fitness facility. A user may make a reservation for a fitness module box among a variety of fitness module boxes provided in a variety of places, at a desirable place and time, and may pay a fee based on the time of use, at the time of reservation or on the site.

In order to achieve the above object, according to one aspect of the present disclosure, there is provided a fitness module box including a box body having an entrance in a side. The box body may include: a framework having a structure including bottom frames, top frames spaced apart from the bottom frames in a top-bottom direction, and side frames connecting the bottom frames and the top frames; and a finishing plate structure finishing outer surfaces of the framework.

One or more sets of exercise equipment may be provided in the box body to be fixed to the finishing plate structure or the framework.

Each frame among the frames of the framework may have a rectangular cross-section, with slide grooves being provided in central portions of surfaces thereof. The finishing plate structure may include a plurality of finishing plate modules which is slid and fitted into the slide grooves.

The plurality of box bodies may be connected to each other using a first fastener and a second fastener. The first fastener may have L-shaped bends on both ends, the L-shaped bends being slid and fitted into corresponding slide grooves of the slide grooves in frames of the frameworks, which are adjoined to each other. The second fastener may be slid and fitted to adjoining surfaces of the frameworks.

The first fastener and the second fastener may be fixed to each other using a holding member. The holding member may include a holder body having a width greater than a distance between the first fastener and the second faster, with a first through-hole being provided in one end of the holder body to conform to the first fastener, and a second through-hole being provided in the other end of the holder body to conform to the second fastener. A distance between the first through-hole and the second through-hole may be equal to the distance between the first fastener and the second faster.

The box body may further include an anti-torsion member provided on portions of the framework to which a finishing plate module among a plurality of finishing plate modules, on which the exercise equipment is fixedly provided, is connected. The anti-torsion member may include a support plate and a pair of fitting ends connected by the support plate and fitted into the slide grooves provided in top surfaces of opposing portions of the framework.

The box body may further include a connecting rod on a fastening portion of the exercise equipment to extend through a fastening-hole of the finishing plate module to be fixed outside of the support plate.

Since the fitness module box according to the present disclosure is provided as a modular structure, two or more such fitness module boxes can be connected together, allowing the scale of the fitness facility to be adjusted in consideration of the number of users. This consequently provides specific merits as follows. An operator may have a significant advantage in terms of the operation of the fitness facility. A user may make a reservation for a fitness module box among a variety of fitness module boxes provided in a variety of places, at a desirable place and time, and may pay a fee based on the time of use, at the time of reservation or on the site.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION

In the description of the present disclosure, terms and words used herein, as well as in the appended claims, should be interpreted as having meanings and concepts conforming to the technical spirit of the present disclosure based on the principle that an inventor may properly define the concept of the terms at his or her own discretion in order to describe the present disclosure in the best manner possible.

Hereinafter, an exemplary embodiment of the present disclosure will be described with reference to the accompanying drawings.

Figure 1:
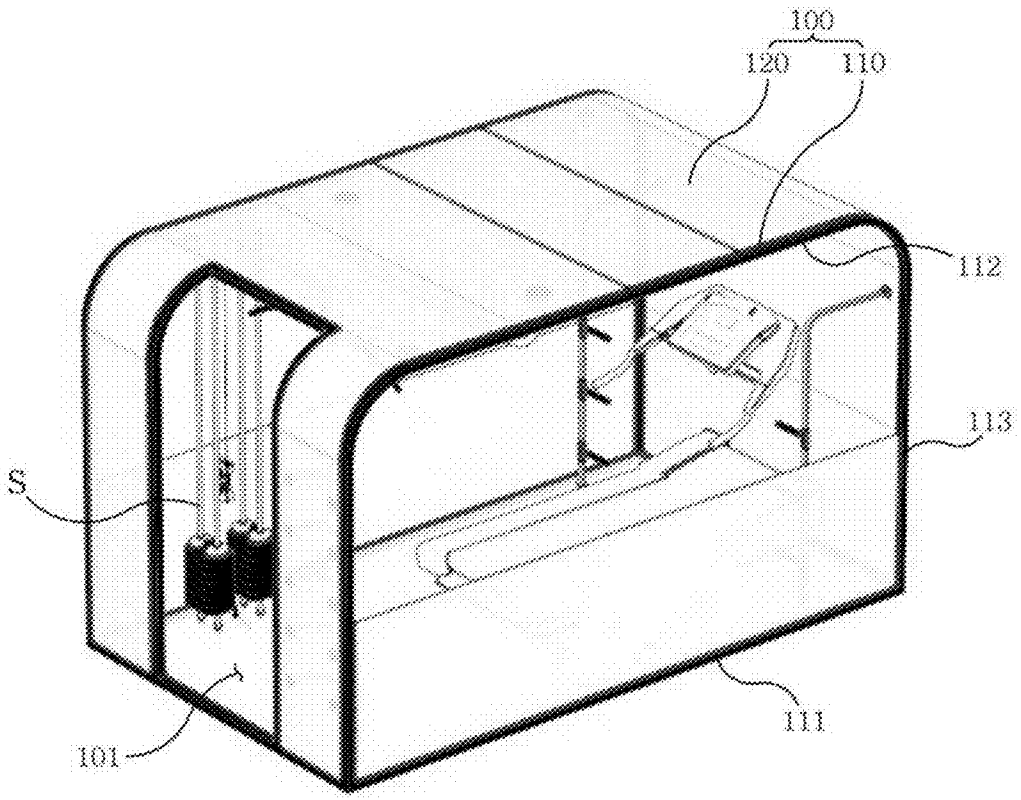
FIG. 1 is a perspective view illustrating an embodiment of a fitness module box according to the present disclosure.
Figure 2:
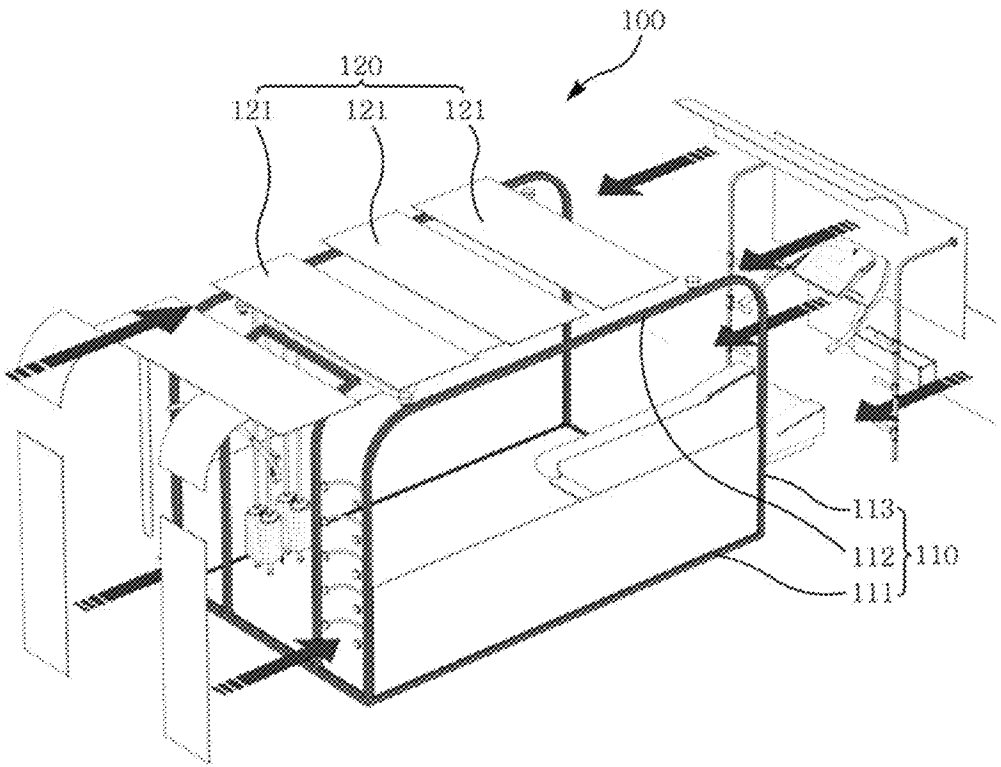
FIG. 2 is an exploded perspective view of FIG. 1.
Figure 3A:
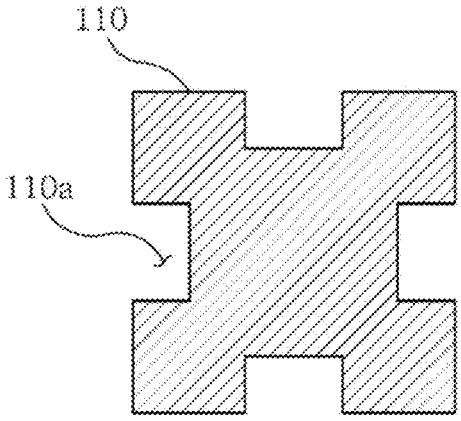
FIGS. 3A and 3B are views illustrating applications of the box body of the fitness module box according to the present disclosure.
Figure 3B:
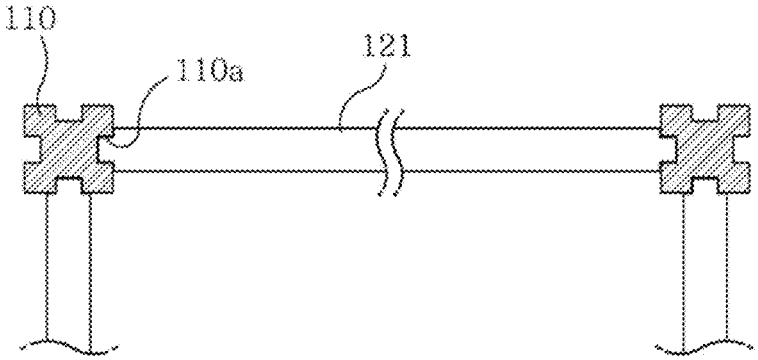
Figure 4A:
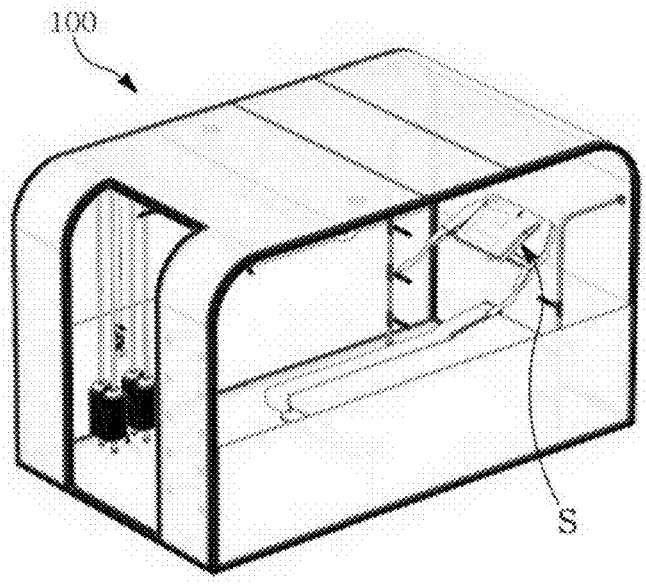
FIGS. 4A to 4C illustrate a variety of embodiments of the fitness module box according to the present disclosure.
Figure 4B:
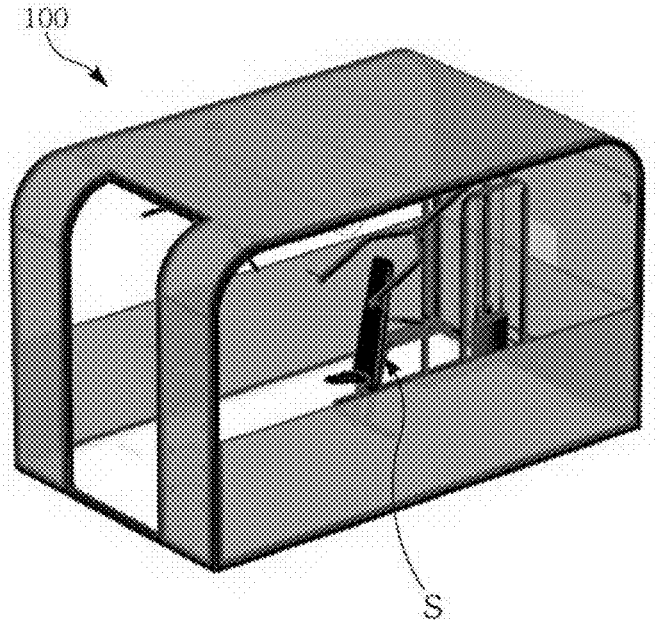
Figure 4C:
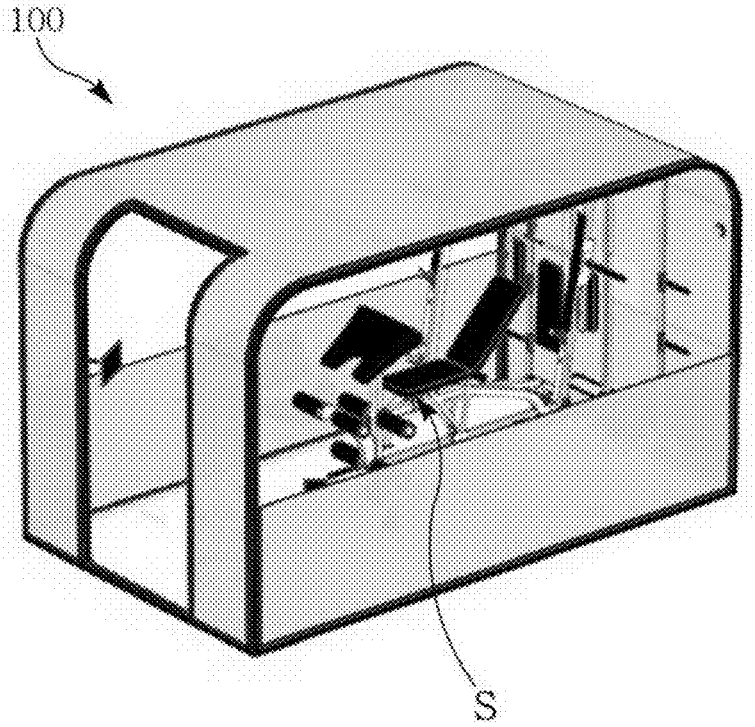
Figure 5:
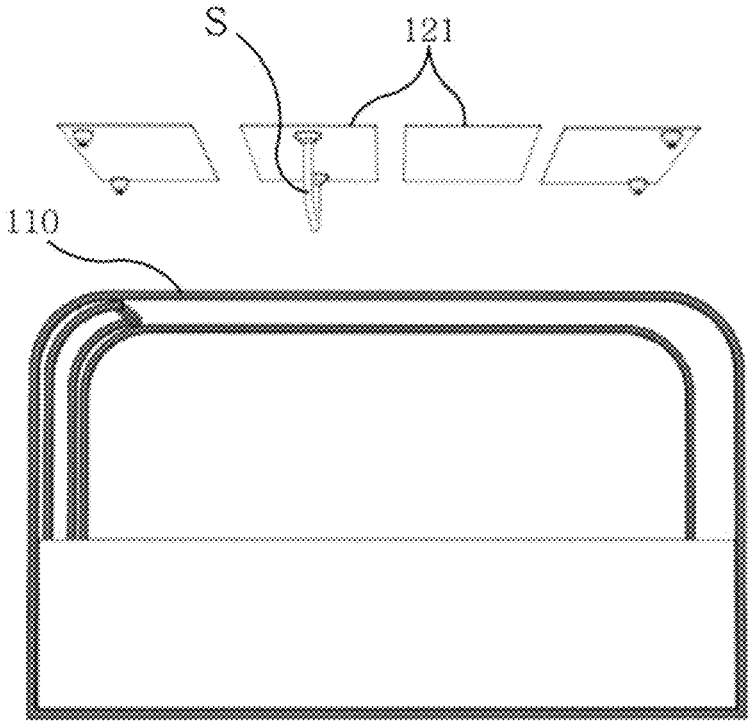
FIG. 5 illustrates an embodiment of the finishing plate modules of the fitness module box according to the present disclosure.
Figure 6A:
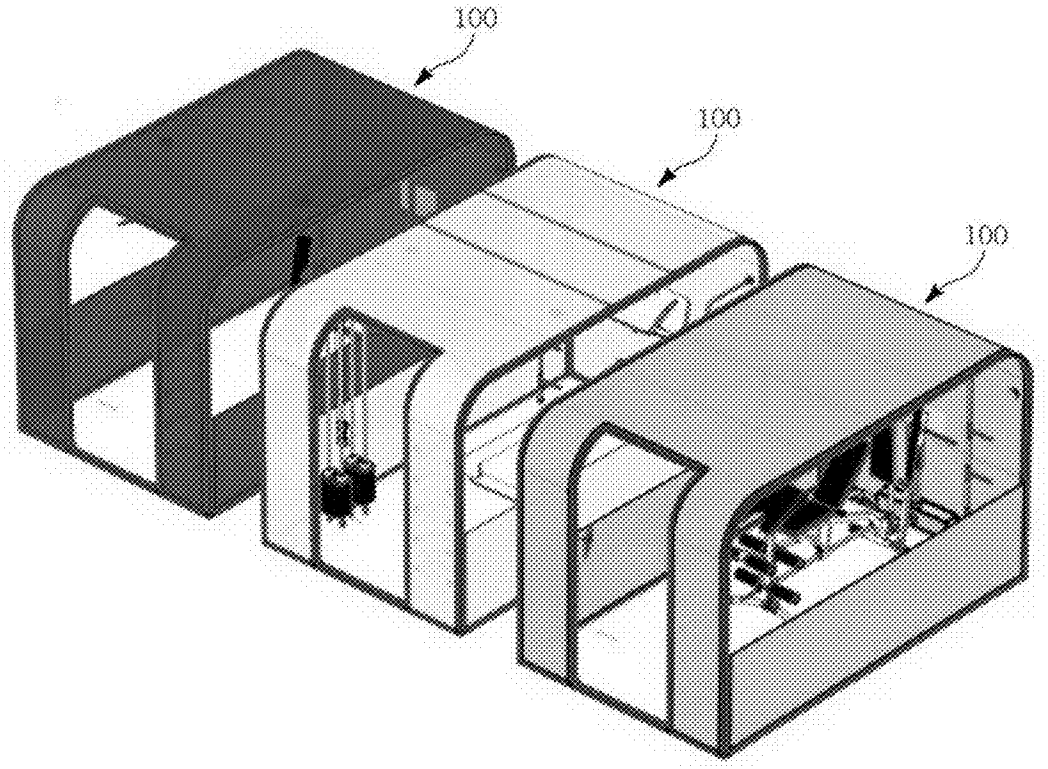
FIGS. 6A and 6B illustrate different applications of the fitness module box according to the present disclosure.
Figure 6B:
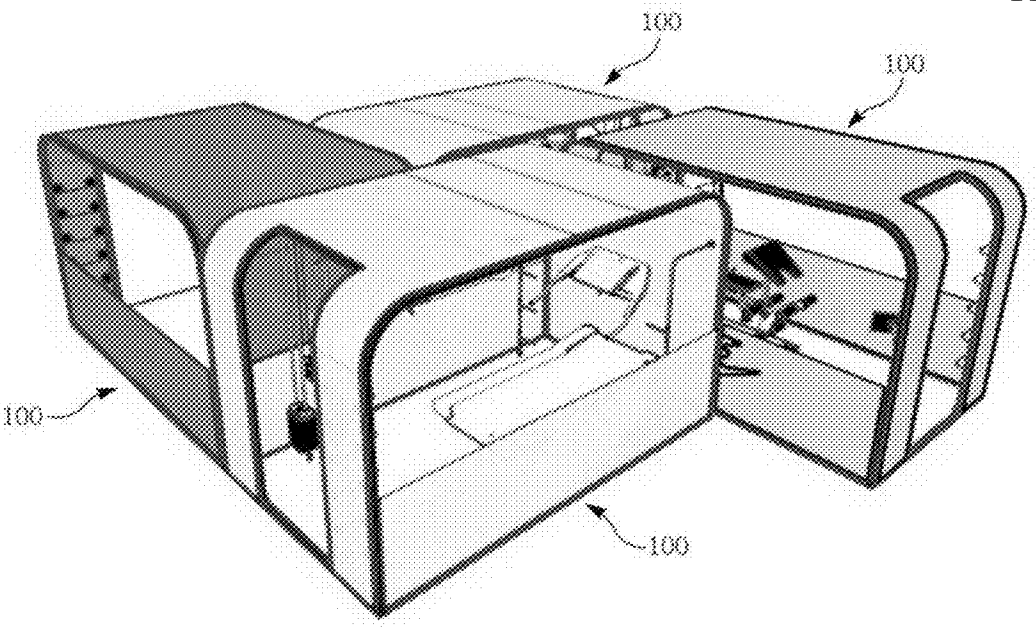
Figure 7:
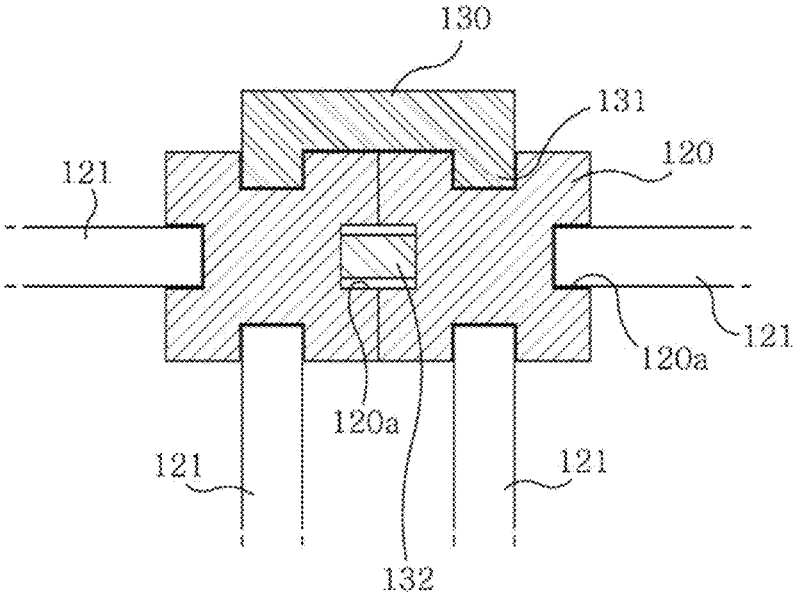
FIG. 7 illustrates an embodiment in which the box bodies of the fitness module box according to the present disclosure are connected to each other.
Figure 8:
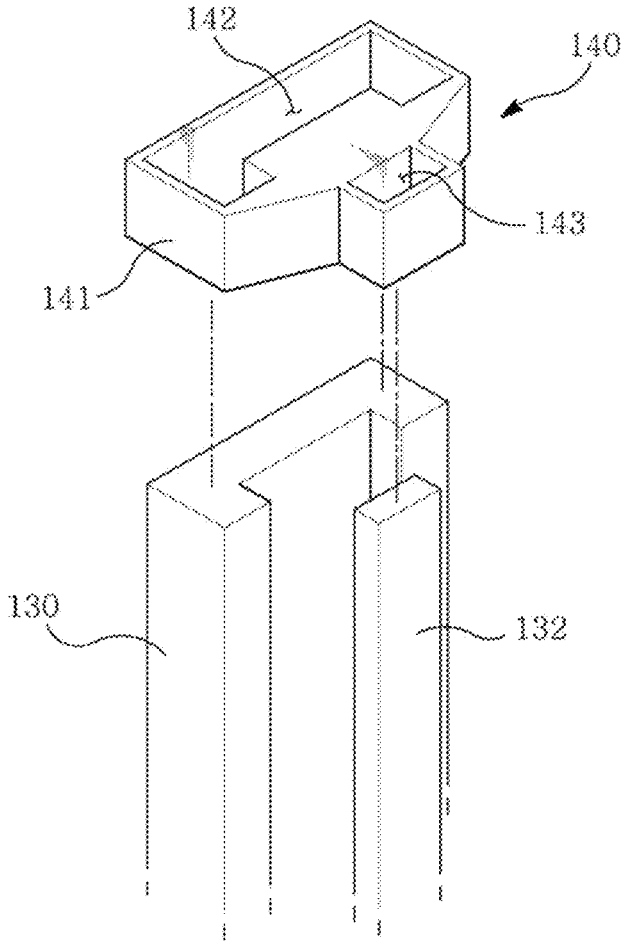
FIG. 8 illustrates an embodiment in which a holding member is added to the configuration illustrated in FIG. 7.

FIG. 1 is a perspective view illustrating an embodiment of a fitness module box according to the present disclosure, FIG. 2 is an exploded perspective view of FIG. 1, FIGS. 3A and 3B are views illustrating applications of the box body of the fitness module box according to the present disclosure, FIGS. 4A to 4C illustrate a variety of embodiments of the fitness module box according to the present disclosure, FIG. 5 illustrates an embodiment of the finishing plate modules of the fitness module box according to the present disclosure, FIGS. 6A and 6B illustrate different applications of the fitness module box according to the present disclosure, FIG. 7 illustrates an embodiment in which the box bodies of the fitness module box according to the present disclosure are connected to each other, and FIG. 8 illustrates an embodiment in which a holding member is added to the configuration illustrated in FIG. 7.

The fitness module box according to the present disclosure is provided as one or more module boxes in a variety of places, such as an outdoor place and an indoor place, the fitness module being configured to accommodate various sets of exercise equipment, such that users who have no or little time to meet an expert can simply use such exercise equipment. Accordingly, the fitness module box according to the present disclosure may be regarded as a mini fitness facility in which at least one of a variety sets of exercise equipment S provided in a typical fitness center is provided therein. The size of the mini fitness facility provided by the fitness module box according to the present disclosure may be expanded to a predetermined size or more by disposing a plurality of such fitness module boxes in a single place.

Since the fitness module box according to the present disclosure is provided as a modular structure, two or more such fitness module boxes can be connected together, allowing the scale of the fitness facility to be adjusted in consideration of the number of users. Thus, an operator may have a significant advantage in terms of the operation of the fitness facility. A user may make a reservation for a fitness module box among a variety of fitness module boxes provided in a variety of places, at a desirable place and time, and may pay a fee based on the time of use, at the time of reservation or on the site.

The fitness module box according to the present disclosure includes a box body 100 having an entrance 101 in one side. The box body 100 includes a framework 110 and a finishing plate structure 120.

As illustrated in FIG. 1, the framework 110 includes bottom frames 111 that may be arranged in a variety of shapes, such as a polygon or a circle, top frames 112 arranged to conform to the bottom frames 111 and located above the bottom frames 111 at a predetermined distance, and a plurality of side frames 113 connecting the bottom frames 111 and the top frames 112.

According to an exemplary embodiment, as illustrated in the drawings, the framework 110 may be in the shape of a rectangular parallelepiped, with the entrance 101 being provided in one side thereof.

In addition, the finishing plate structure 120 is configured to finish the outer surfaces of the framework 110. As illustrated in the drawings, the finishing plate structure 120 can completely finish both the top surface and the bottom surface of the framework 110 while leaving a portion of the side surfaces of the framework 110 as being opened. The finishing plate structure 120 may be selectively made of an opaque material or a transparent material.

As illustrated in FIGS. 4A to 4C, one or more sets of exercise equipment S may be provided within the box body 100 according to the present disclosure. In some cases, a mat or the like may only be provided on the bottom surface within the box body 100, such that a user can conduct stretching, yoga, Pilates, other types of equipment-free exercises, or the like.

In addition, the box body 100 may be substituted for another box body to comply with users wishing to use various sets of exercise equipment S.

The term "exercise equipment" used herein may be interpreted as a concept collectively referring to all types of equipment, such as a running machine and a bench press, provided in a typical fitness center, with which users can conduct aerobic exercise, muscular exercise, and the like.

For example, when a running machine is provided within the box body 100 as illustrated in FIGS. 1 and 2, the front portion and the bottom surface of the running machine may be fixed to the framework 110 and the finishing plate structure 120. Accordingly, the user can more effectively exercise, and the exercise equipment S can be prevented from being lost.

Hereinafter, an embodiment of the box body 100, i.e. a component of the present disclosure, will be described with reference to FIGS. 2 and 3.

The box body 100 according to the present embodiment includes the framework 110 and the finishing plate structure 120. As illustrated in FIG. 3A, the framework 110 has one or more slide grooves 110*a* in one or more surfaces.

More specifically, as illustrated in the drawings, the framework 110 may have a rectangular cross-section, and the slide grooves 110*a* may be recessed in the central portions of the surfaces, respectively.

In addition, as illustrated in FIG. 2, the finishing plate structure 120 includes a plurality of finishing plate modules 121 slid and fitted to the slide grooves 110*a*. Specifically, as illustrated in FIG. 3B, both edges of each of the finishing plate modules 121 may be introduced between a pair frames of the framework 110 to be sequentially slid and fitted into the slide grooves 110*a* of the pair of frames of the framework 110.

As illustrated in FIG. 5, the exercise equipment S with which the user can conduct a chin-up or the like is integrally connected to a corresponding one of the finishing plate modules 121 provided on the ceiling of the box body 100. A camera able to capture exercise postures of the user may be provided on a corresponding one of the finishing plate modules 121. The exercise equipment S with which the user can conduct a chin-up, the camera, or the like may be simply provided in the box body 100 by slidably connecting the corresponding finishing plate module 121 to the framework 110.

The camera provided within the box body 100 according to the present disclosure as described above can capture images of the exercising user, allowing the user to check his/her exercising postures. Otherwise, the user may improve his/her exercising method or postures by transmitting the captured images to an expert.

According to the present disclosure, a plurality of box bodies 100 are arranged, and various sets of exercise equipment S may be provided in the box bodies 100, such that users can use more various sets of exercise equipment S in a single place. In this case, each box body 100 may be configured to be connected to the other box bodies 100.

First, as illustrated in FIGS. 6A and 6B, the box bodies 100 may be arranged in a variety of arrays. When the box bodies 100 are closely adjoined to each other, the box bodies 100 may be firmly connected to each other using first fasteners 130 and second fasteners 132.

As described above, each of the frameworks 110 has a rectangular cross-section, the slide grooves 110*a* are recessed in the central portions of the side surfaces. As illustrated in the drawings, each of the first fasteners 130 is generally in the shape of the letter "U," in which bends 131 in the shape of the letter "L" are provided on both end portions. The bends 131 are slid and fitted into the slide grooves 110*a* of the framework 110.

In addition, the second fasteners 132 are configured to be fitted into the slide grooves 110*a* provided on opposite surfaces of the frameworks 110. Since coupling structures in which both the first fasteners 130 and the second fasteners 132 are used to connect the frameworks 110 each other, the frameworks 110 can be more strongly coupled, thereby perfectly preventing the connected box bodies 100 from being disconnected.

In addition, portions of the first fasteners 130 and the second fasteners 132, on one side or both sides of the framework 110, may be exposed externally. The exposed portions of the first and second fasteners 130 and 132 may be fixed to each other using a holding member 140. This can consequently provide a stronger fastening structure for the box bodies 100 connected to each other.

As illustrated in FIG. 8, each of the holding members 140 includes a holder body 141, a first through-hole 142, and a second through-hole 143.

As illustrated in the drawing, the holder body 141 is provided as a single unitary structure, with a longitudinal width thereof being greater than the distance between the first fastener 130 and the second fastener 132, and a lateral width thereof being greater than the width of the first fastener 130.

In addition, the first through-hole 142 is provided in one end of the holder body 141 to conform to the first fastener 130, such that the first fastener 130 can be fitted into the first through-hole 142.

Likewise, the second through-hole 143 is provided in the other end of the holder body 141 to conform to the second fastener 132, such that the second fastener 132 can be fitted into the second through-hole 143.

The distance between the first through-hole 142 and the second through-hole 143 is the same as the distance between the first fastener 130 and the second fastener 132, such that the first fastener 130 and the second fastener 132 can be easily fitted into the first through-hole 142 and the second through-hole 143, so that the holder body 141 can be easily coupled to the first fastener 130 and the second fastener 132.

Since the first fasteners 130 can be easily fastened to and integrated with the second fasteners 132 using the holder bodies 141, resistance against impacts applied to or distortion occurring in the connected box bodies 100 can be increased, so that the connected box bodies 100 can firmly stay connected to each other.

As illustrated in FIG. 5, a set of exercise equipment S with which a user can conduct a chin up or the like may be provided on one of the finishing plate modules 121. In this case, the finishing plate module 121 may be dislodged from the framework 110 by load repeatedly applied thereto due to repeated use of the exercise equipment S, thereby causing an accident or the like, which is problematic.

Figure 9:
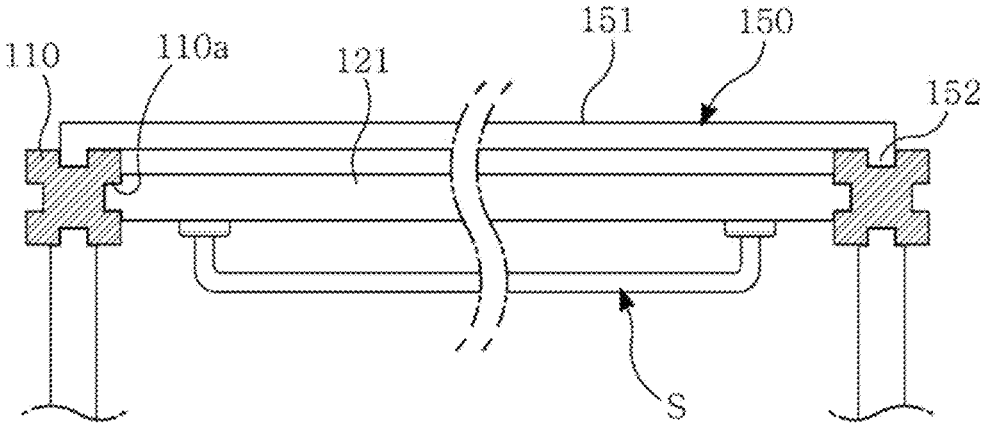
FIG. 9 is a side cross-sectional view illustrating an embodiment in which an anti-torsion member is added to the configuration illustrated in FIG. 5.

In this regard, as illustrated in FIG. 9, the present disclosure discloses an embodiment in which an anti-torsion member 150 is provided on specific frames (e.g. specific top frames) of the framework 110 to which the finishing plate module 121 among the finishing plate modules 121, on which the exercise equipment S is provided, is connected. The anti-torsion member 150 includes a support plate 151 and a pair of fitting ends 152 connected by the support plate 151 and fitted into the slide grooves 110*a* provided in the top surfaces of opposing frames of the framework 110.

The anti-torsion member 150 is configured to increase resistance against distortion in the framework 110, with the fitting ends 152 bent on both ends of the support plate 151 being fitted into the slide grooves 110*a* provided on the top surfaces of the frames of the framework 110. Due to this configuration, when a load is repeatedly applied to the finishing plate module 121, to which the exercise equipment S is fixed, the anti-torsion member 150 can control distortion in the framework 110 caused by the finishing plate modules 121, thereby preventing the finishing plate module 121 from being dislodged from the framework 110.

Figure 10:
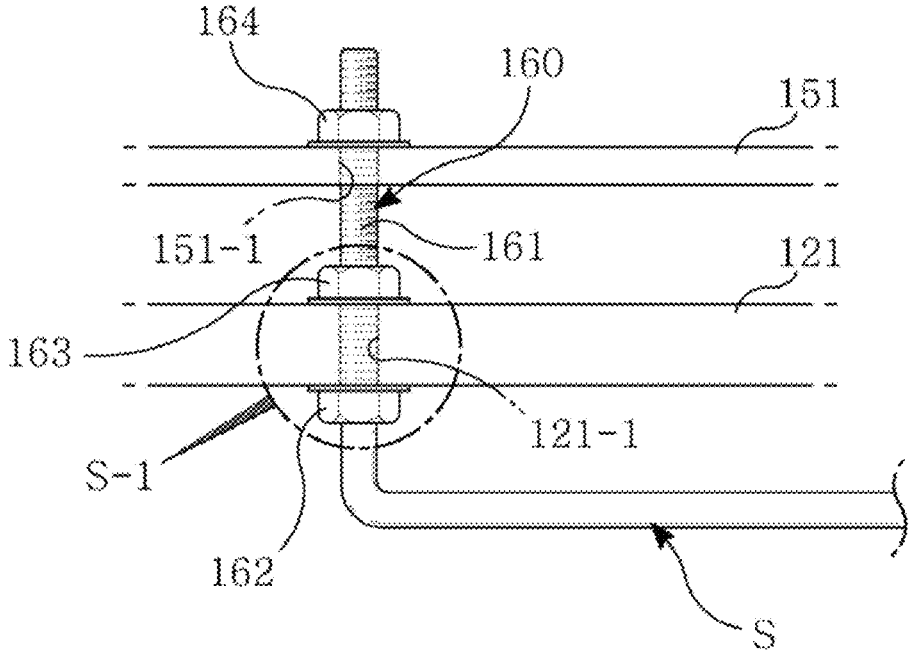
FIG. 10 is a cross-sectional view illustrating a portion of a modification of the embodiment illustrated in FIG. 9.

In addition, as illustrated in FIG. 10, a connecting rod 160 is provided on a fastening portion S-1 of the exercise equipment S to extend through the finishing plate module 121. The connecting rod 160 extends through a fastening-hole 151-1 of the support plate 151 and is fixed outside of the support plate 151.

Describing the present embodiment in more detail, the connecting rod 160 is integrally provided on the exercise equipment S, with threads 161 being provided on the connecting rod 160 except for the proximal end thereof. The connecting rod 160 is inserted into a second fastening-hole 121-1 of the finishing plate module 121, and is secured on both surfaces of the finishing plate module 121 using nuts 162 and 163, so that the exercise equipment S is fixed to the finishing plate module 121. In this position, the anti-torsion member 150 is fastened to the assembled framework 110 (which is not shown in FIG. 10), so that the connecting rod 160 is inserted into the fastening-hole 151-1 of the support plate 151 of the anti-torsion member 150. The connecting rod 160, inserted into the fastening-hole 151-1 of the support plate 151 of the anti-torsion member 150, is secured on an outer surface of the support plate 151 using a nut 164, so that force acting on the finishing plate module 121 can be transferred to the anti-torsion member 150.

The above-described configuration can improve the ability of the anti-torsion member 150 to resist distortion in the framework 110 while ensuring the finishing plate module 121 and the anti-torsion member 150 resist repeated load, thereby increasing structural soundness.

Although the exemplary embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A fitness module box comprising a box body having an entrance in a side, wherein the box body comprises:

a framework having a structure comprising bottom frames, top frames spaced apart from the bottom frames in a top-bottom direction, and side frames connecting the bottom frames and the top frames; and a finishing plate structure forming walls of the framework, wherein one or more sets of exercise equipment are provided in the box body to be fixed to the finishing plate structure or the framework, wherein each frame of the framework has a rectangular cross-section with slide grooves being provided in central portions of surfaces thereof, wherein the finishing plate structure comprises a plurality of finishing plate modules which are slid and fitted into corresponding slide grooves, wherein one set of the one or more sets of exercise equipment is fixed to one of the plurality of finishing plate modules, wherein the box body further comprises an anti-torsion member provided on portions of the framework to which the one of the plurality of finishing modules is connected, wherein the anti-torsion member comprises a support plate and a pair of fitting ends connected by the support plate and fitted into the slide grooves provided in top surfaces of opposing portions of the framework, and wherein the box body further comprises a connecting rod on a fastening portion of the one set of the one or more sets of exercise equipment to extend through a fastening-hole of the finishing plate wherein the connecting rod extends through the support plate and is fixed to a top surface of the support plate.

2. The fitness module box according to claim 1, wherein the box body further comprises a camera configured to capture images of an exercising user and to transmit the captured images to an expert.

3. The fitness module box according to claim 1, wherein the anti-torsion member is configured to increase resistance against distortion with the fitting ends bent on both ends of the supporting plate.

4. The fitness module box according to claim 3, wherein the fitness module box further comprises a first fastener and a second fastener configured to connect a plurality of box bodies, wherein the first fastener has L-shaped bends on both ends, the L-shaped bends being slid and fitted into corresponding slide grooves of the slide grooves in frames of the framework, which are adjoined to each other, and the second fastener is slid and fitted to adjoining surfaces of the framework.

5. The fitness module box according to claim 4, wherein the first fastener and the second fastener are fixed to each other using a holding member, wherein the holding member comprises a holder body having a width greater than a distance between the first fastener and the second fastener, with a first through-hole being provided in one end of the holder body to conform to the first fastener, and a second through-hole being provided in the other end of the holder body to conform to the second fastener, a distance between the first through-hole and the second through-hole being equal to the distance between the first fastener and the second faster.

* * * * *